US009433957B2

(12) United States Patent
Nardi et al.

(10) Patent No.: US 9,433,957 B2
(45) Date of Patent: Sep. 6, 2016

(54) COLD SPRAY SYSTEMS WITH IN-SITU POWDER MANUFACTURING

(71) Applicant: UNITED TECHNOLOGIES CORPORATION, Farmington, CT (US)

(72) Inventors: Aaron T. Nardi, East Granby, CT (US); Michael A. Klecka, Vernon, CT (US); Daniel V. Viens, Mansfield Center, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/591,091

(22) Filed: Jan. 7, 2015

(65) Prior Publication Data

US 2015/0190824 A1 Jul. 9, 2015

Related U.S. Application Data

(60) Provisional application No. 61/924,760, filed on Jan. 8, 2014.

(51) Int. Cl.

| | |
|---|---|
| ***B05B 7/32*** | (2006.01) |
| ***B05B 7/14*** | (2006.01) |
| ***C23C 24/04*** | (2006.01) |
| ***B22F 9/14*** | (2006.01) |

(52) U.S. Cl.

CPC ..... *B05B 7/1404* (2013.01); *B22F 9/14* (2013.01); *C23C 24/04* (2013.01); *B22F 2999/00* (2013.01)

(58) Field of Classification Search

CPC ..... B05B 3/026; B05B 9/03; B05B 11/0037; B05B 2203/0247

USPC ..... 239/302, 310, 337, 349

See application file for complete search history.

(56) References Cited

U.S. PATENT DOCUMENTS

| | | | | |
|---|---|---|---|---|
| 3,713,491 | A * | 1/1973 | Grabowski | A62C 37/00 169/28 |
| 4,452,239 | A * | 6/1984 | Malem | A61M 15/00 128/200.14 |
| 7,878,258 | B2 * | 2/2011 | Lindstrom | A62C 35/02 169/30 |
| 2003/0232132 | A1 * | 12/2003 | Muehlberger | C23C 24/04 427/180 |
| 2005/0178851 | A1 * | 8/2005 | Shutic | B05B 7/1454 239/124 |
| 2008/0271903 | A1 * | 11/2008 | Lindstrom | A62C 35/02 169/61 |

* cited by examiner

*Primary Examiner* — Davis Hwu
(74) *Attorney, Agent, or Firm* — Cantor Colburn LLP

(57) ABSTRACT

A cold spray system includes a powder generator and a powder feeder. The powder generator has a powder source disposed within a housing. The powder feeder is in fluid communication with the housing and the powder generator within the housing. A closed circuit defined from the powder generator to the powder feeder conveys powder from the powder generator to the powder feeder without exposing the powder to contaminates from outside the closed circuit.

19 Claims, 4 Drawing Sheets

COLD SPRAY SYSTEMS WITH IN-SITU POWDER MANUFACTURING

CROSS-REFERENCE TO RELATED APPLICATION

This application claims the benefit of priority under 35 U.S.C. §119(e) to U.S. Provisional Application No. 61/924,760, filed Jan. 8, 2014, which is incorporated herein by reference in its entirety.

BACKGROUND OF THE INVENTION

1. Field of the Invention

The present disclosure relates to cold spray systems, and more particularly to powder feedstock manufacturing for cold spray systems.

2. Description of Related Art

Cold spray processes are used to develop coatings on target substrates. The coatings can be thin or thick, and form protective or performance enhancing layers on the substrate. The layers can also repair damage to the underlying substrate. The coatings can be formed from materials such as aluminum, copper, iron, or nickel. The coatings can also be formed from high strength alloys, such as Inconel® for example.

Cold spray processes form coatings by propelling powder feedstock particles to extremely high speeds by a carrier gas through a nozzle oriented toward a target substrate. The particles impact the substrate with sufficient kinetic energy to deform plastically and bond with the substrate, thereby forming a coating on the substrate. Cold spray is distinguishable from other spray deposition processes that melt the feedstock particles prior to propelling the particles toward the substrate, such as thermal and plasma spray processes. In contrast, cold spray processes typically do not change the physical state or chemical composition of the feedstock particles between their introduction into the system and their application to the substrate.

Not changing the state or chemistry of the feedstock particles has advantages and disadvantages. Since the chemical composition of the feedstock particles generally does not change introduction of the powder feedstock into the cold spray system and application to the substrate, coatings developed by cold spray processes generally have the same composition the powder feedstock material introduced to the cold spray system. For this same reasons, however, impurities or contaminates in powder feedstock introduced to the cold spray system can be incorporated into the coating developed on the substrate. This can pose challenges to cold spray processes using powder feedstock materials tending to form oxides or hydroxides when exposed to the ambient environment, like aluminum for example, as the oxides and hydroxides can change the coating composition, potentially altering the coating performance.

Conventional cold spray systems and methods have generally been considered satisfactory for their intended purpose. However, there is a need in the art for improved systems and methods for generating powder feedstock for cold spray systems. The present disclosure provides a solution for these problems.

SUMMARY OF THE INVENTION

A cold spray system includes a powder generator and a powder feeder. The powder generator incudes a powder source disposed within a housing. The powder feeder is in fluid communication with the powder generator. A closed circuit defined between the powder generator and powder feeder allows for conveying powder from the powder generator to the powder feeder without exposing the powder to contaminate (atmosphere, moisture, oxygen, etc.) from outside of the closed circuit.

In certain embodiments, the powder generator is maintained within an inert atmosphere. The powder generator can include feedstock wires housed within the powder generator. A feedstock wire can be electrically connected to voltage source terminal for developing an electric arc between the wire and a voltage return terminal. The arc can convert the wire into particulate, i.e. feedstock powder, as the wire is fed into the arc.

In accordance with certain embodiments, the system includes a motive gas system in fluid communication with the powder generator for propelling the feedstock powder through the closed circuit. The motive gas system can include a supply of inert gas such as argon, helium, and nitrogen. The feedstock powder particles manufactured by the powder generator and conveyed through the closed circuit to the powder feeder can have surface and interior portions with the same composition.

It is contemplated that the system can include a feedstock powder classifier in fluid communication with the powder generator. The classifier can remove feedstock powder of a size outside of a predetermined size range from a flow of feedstock powder conveyed through the closed circuit. The classifier can include a vortex generator for separating particles by particle size. The system can also include a quarantine module with an inert atmosphere and in selective fluid communication with the classifier. It is contemplated that the quarantine module can capture and impound particles separated by the classifier from the feedstock powder flow that are outside of the predetermined size range in an inert atmosphere. The classifier can have a first outlet in fluid communication with the feedstock hopper for discharging a flow of particles within the predetermined range and a second outlet in fluid communication with the quarantine module for discharging a flow of particles outside of the predetermined range. It is also contemplated that the closed circuit defined from the powder generator to the powder feeder can include both the classifier and feedstock hopper described above for conveying powder from the powder generator to the powder feeder without exposing the powder to contaminate from outside the closed circuit.

It is further contemplated that the system can include a feedstock hopper in fluid communication with the powder generator. The powder feeder can regulate between mismatches in powder generator feedstock powder manufacture rates and feedstock powder application rate. The system can include a nozzle in fluid communication with the powder generator for issuing a spray of powder at a substrate arranged opposite the nozzle.

A method of cold spraying includes generating powder, conveying the powder, and issuing the power as a spray. The generating operation includes generating powder within an inert environment of a powder generator chamber, the conveying operation includes conveying the generated powder to a powder feeder in fluid communication with the power generator through a closed circuit without exposing the powder to contaminate from outside the closed circuit, and the issuing operation includes issuing a stream of particles from a nozzle in fluid communication with the powder feeder.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
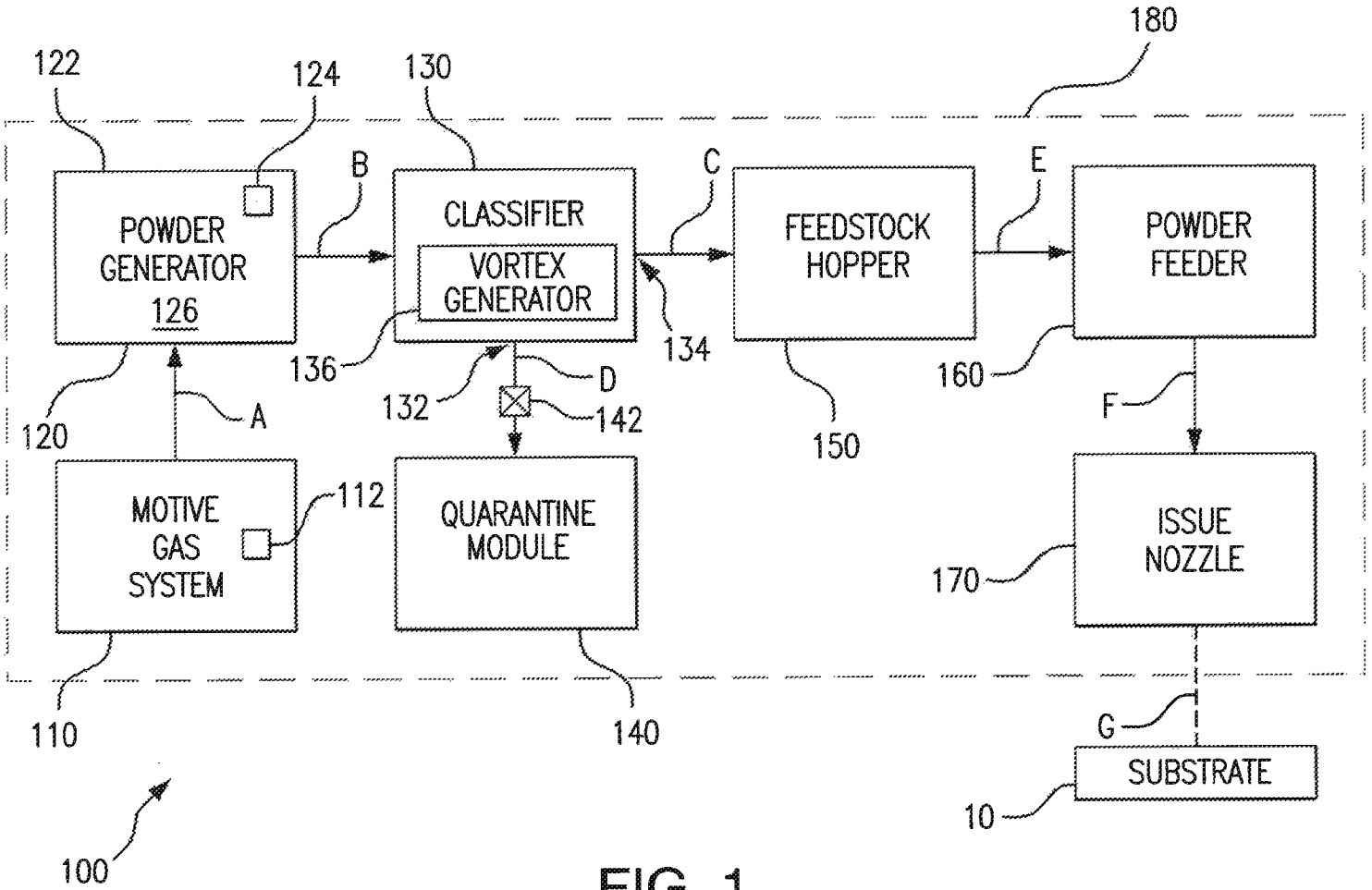
FIG. 1 is a schematic view of an exemplary embodiment of a cold spray system with in-situ powder manufacturing constructed in accordance with the present disclosure, showing the elements of the closed circuit for preventing feedstock powder contamination.

Reference will now be made to the drawings wherein like reference numerals identify similar structural features or aspects of the subject disclosure. For purposes of explanation and illustration, and not limitation, a partial view of an exemplary embodiment of a cold spray system in accordance with the disclosure is shown in FIG. 1 and is designated generally by reference character 100. Other embodiments of the cold spray system in accordance with the disclosure, or aspects thereof, are provided in FIGS. 2-4, as will be described. The systems and methods described herein can be used for coating substrates with uniform material deposits, such as aluminum and aluminum alloys, for example.

Cold spray system 100 includes a motive gas system 110, a powder generator 120, a classifier 130, and a quarantine module 140. Cold spray system 100 also includes a feedstock hopper 150, a powder feeder 160, and an issue nozzle 170. Motive gas system 110 is in fluid communication with powder generator 120. Powder generator 120 is in fluid communication with classifier 130. Classifier 130 is in fluid communication with feedstock hopper 150. Classifier 130 is also in selective fluid communication with quarantine module 140. Feedstock hopper 150 is in fluid communication with powder feeder 160. Powder feeder 160 is in fluid communication with issue nozzle 170.

Cold spray system 100 can be a closed system including a closed circuit 180 (indicated with the dashed lines in FIG. 1). Closed circuit 180 can include powder generator 120 and powder feeder 160 for providing a flow of particles without contact with the atmosphere external to closed circuit 180 to prevent contact with the contaminants. Closed circuit 180 can also include at least one of motive gas system 110, classifier 130, quarantine module 140, feedstock hopper 150, and issue nozzle 170. Closed circuit 180 can include suitable intervening elements, e.g. conduits, for placing system elements in fluid communication with one another.

Motive gas system 110 has a gas supply 112. Powder generator 120 receives a motive gas flow A from motive gas system 110 (and gas supply 112) for propelling particles produced in powder generator 120 through closed circuit 180. Gas supply 112 can be an inert gas. Non-limiting examples of the inert gas include noble gases such as argon or helium, and inert gases such as nitrogen. Use of an inert gas allows for conveying powder from powder generator 120 to powder feeder 160 without exposing the powder to contaminate from outside closed circuit 180 as closed circuit 180 conveys the powder in an inert environment. Conveying the powder using an inert gas prevents incorporation of impurities such as oxides or hydroxides as well as other contaminates on the surface of the powder particles as the particles move through cold spray system 100. Preventing incorporation contamination or impurities in the powder allows for production and delivery of particles to a substrate 10 such that the surface and interior portions of the particles have substantially the same composition (e.g. same chemical composition).

Powder generator 120 includes a housing 122 and a powder source 124. Housing 122 defines an internal chamber 126 enveloping powder source 124 within an inert atmosphere. The inert atmosphere may include the same gas as supplied by motive gas system 110.

Classifier 130 includes a first outlet 132, a second outlet 134, and a vortex generator 136. The flow of particles received by classifier 130 can be of mixed size, and more specifically, the received particles can include particles in a range outside of a size range suitable for the cold spray process. Classifier 130 is configured for removing particles outside of the predetermined size range from the particle flow into classifier 130 using vortex generator 136.

Vortex generator 136 is in fluid communication with powder source 124 and receives a flow of powder particles B from powder source 124. Vortex generator 136 is also in fluid communication with quarantine module 140 through first outlet 132 and with feedstock hopper 150 through second outlet 134. Vortex generator 136 separates particles outside of the predetermined size range using cyclic separation. Once separated, vortex generator 136 conveys particles within the predetermined size range to feedstock hopper 150 through first outlet 132 and particles outside of the predetermined size range to quarantine module 140 through second outlet 134. It is contemplated that classifier 130 can employ other separation mechanisms for separating particles outside of the predetermined size range, such as screens and/or filters for example, such as would be suitable for an intended cold spray process.

Quarantine module 140 receives a flow of particles D outside of the predetermined range from classifier 130 through second outlet 134. Quarantine module 140 selectively receives the particle flow through operation of a valve 142 and is configured for impounding (e.g. capturing) and storing the particles within an inert atmosphere. The inert atmosphere maintained within quarantine module 140 may include the same gas as supplied by motive gas system 110. This potentially reduces the cost of operation of cold spray system 100 as the impounded particles can be recycled for use in another operation, such as by being introduced through an inert coupling into powder feeder 160 for deposition using a different cold spray process or substrate.

Feedstock hopper 150 receives a flow of particles C within the predetermined range from classifier 130 through first outlet 132. Feedstock hopper 150 stores a supply of powder within the predetermined size range for supply at a uniform rate to powder feeder 160. This allows for regulating mismatches between powder feedstock production rates in powder generator 120 and powder feedstock usage rates by a given cold spray process. It can also allow for intermittent operation of powder generator 120 during powder application operation by developing a 'buffer' stock of powder in feedstock hopper 150.

Powder feeder 160 receives a particle flow E from feedstock hopper 150. The flow rate of particle flow E may exceed that required by the cold spray process in terms mass flow rate or volume. Powder feeder 160 receives particle flow E and outputs a particles flow F which may be greater or less than that of particle flow F, such as by metering the received particle flow through a metering body, matching particle F to that required for a given cold spray process. Reconciliation of the rate of powder generation with the rate of powder use (issue) balances powder generation and utilization of powder by decoupling the powder manufacturing and powder deposition processes, enhancing operational flexibility of the system. For example, in processes where powder generator 120 creates powder more rapidly than deposited by cold spray system 100, powder feeder 160 can reduce powder supplied to issue nozzle 170. In processes where powder generator 120 tends to run behind, powder feeder 160 can augment powder flow by adding powder 'banked' in feedstock hopper 150 to powder generated by powder generator 120.

Powder feeder 160 provides a metered particle flow as a particle flow F to issue nozzle 170. Issue nozzle 170, oriented toward a target substrate 10, receives flow F from powder feeder 160 and propels the particles as a flow G toward substrate 10. Particles within flow G have sufficient velocity to impact substrate 10 with sufficient energy to plastically deform and metallurgically bond with substrate 10 and/or the coating developed thereon. Since motive gas source 100 coveys the powder feedstock particles of flow G in an inert atmosphere, coatings formed by flow G are substantially uniform and is free of contamination and impurities such as oxides or hydroxides.

While cold spray system 100 is described above and illustrated in FIG. 1 as a system with seven components, (i.e. motive gas system 110, powder generator 120, classifier 130, quarantine module 140 feedstock hopper 150, powder feeder 160, and issue nozzle 170), embodiments of the system can employ a subset of the above described elements. For example, simplified embodiments of cold spray system 100 can be limited to motive gas system 110, powder generator 120 and issue nozzle 170. This potentially provides a cold spray system with enhanced operational flexibility, such as for a mobile cold spray operation for example.

Figure 2:
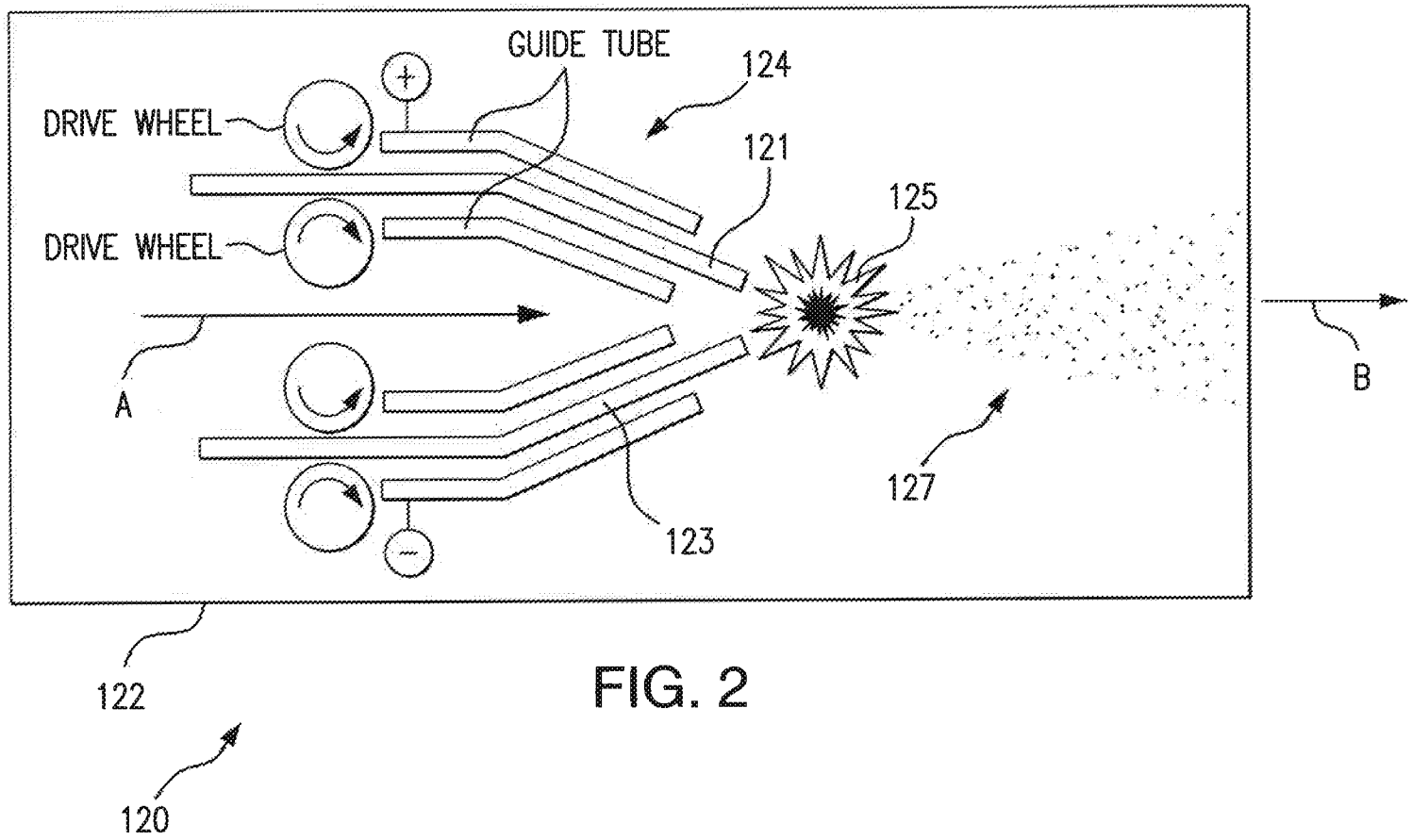
FIG. 2 is a schematic cross-sectional view of the powder generator of the cold spray system of FIG. 1, showing the powder generator.

With reference to FIG. 2, powder generator 120 is shown schematically. Powder generator 120 includes powder source 124 enveloped within housing 122. Powder source 124 includes a first feedstock wire 121 and a second feedstock wire 123. Drive wheels and opposed guide tubes direct first and second feedstock wires 121 and 123 toward one another. Motive flow A, introduced into housing 122 by motive gas source 110 between the guide tubes and between first and second feedstock wire 121 and 123, provides as inert atmosphere within powder generator 120 and conveys feedstock powder from powder generator 120 as the feedstock powder forms. First and second feedstock wires 121 and 123 are constructed from a suitable material for generating a coating on substrate 10 (shown in FIG. 1). Non-limiting examples of suitable feedstock wire include aluminum or aluminum alloy wire. Suitable feedstock can also be in the form of bar or rod-shaped stock.

First and second feedstock wires 121 and 123 electrically connect to a voltage source terminal 126 (i.e. a positive voltage terminal) and a voltage return terminal 128 (i.e. a negative voltage terminal). Source voltage terminal 126 and return voltage terminal 128 establish a potential difference between the wires that increases as the wires approach one another. The potential difference is of suitable magnitude such that an arc 125 develops between adjacent ends of the wire. Arc 125 decomposes the adjacent ends of first and second feedstock wires 121 and 123, forming feedstock powder particulate 127. The drive wheels feed first and second feedstock wires 121 and 123 through each guide tube such that feedstock wire is fed into arc 125 at the same rate that arc 125 decomposes first and second feedstock wires 121 and 123, continuously manufacturing of powder feedstock particulate 127. This process occurs in an inert atmosphere (environment) maintained within housing 122.

Motive gas source 110 introduces motive flow A into feedstock generator 120 such that powder feedstock particulate 127 forms particle flow B. Particle flow B exits powder generator 120 and is received by classifier 130. Classifier 130 receives particle flow B and separates particles as described above.

Embodiments of the systems and methods described herein are not limited to twin wire powder generators. For example, powder stream 127 can be manufactured using a single wire arc source. Powder stream 127 can also be manufactured using alternate electrode geometries employed within the inert atmosphere chamber. Embodiments of cold spray system 100 can also include powder generators with dynamic seals configured to receive wire fed from one or more wire spools arranged externally to housing. This potentially makes operation more reliable by allowing for extending operation without disturbing the inert atmosphere within the system.

Figure 3:
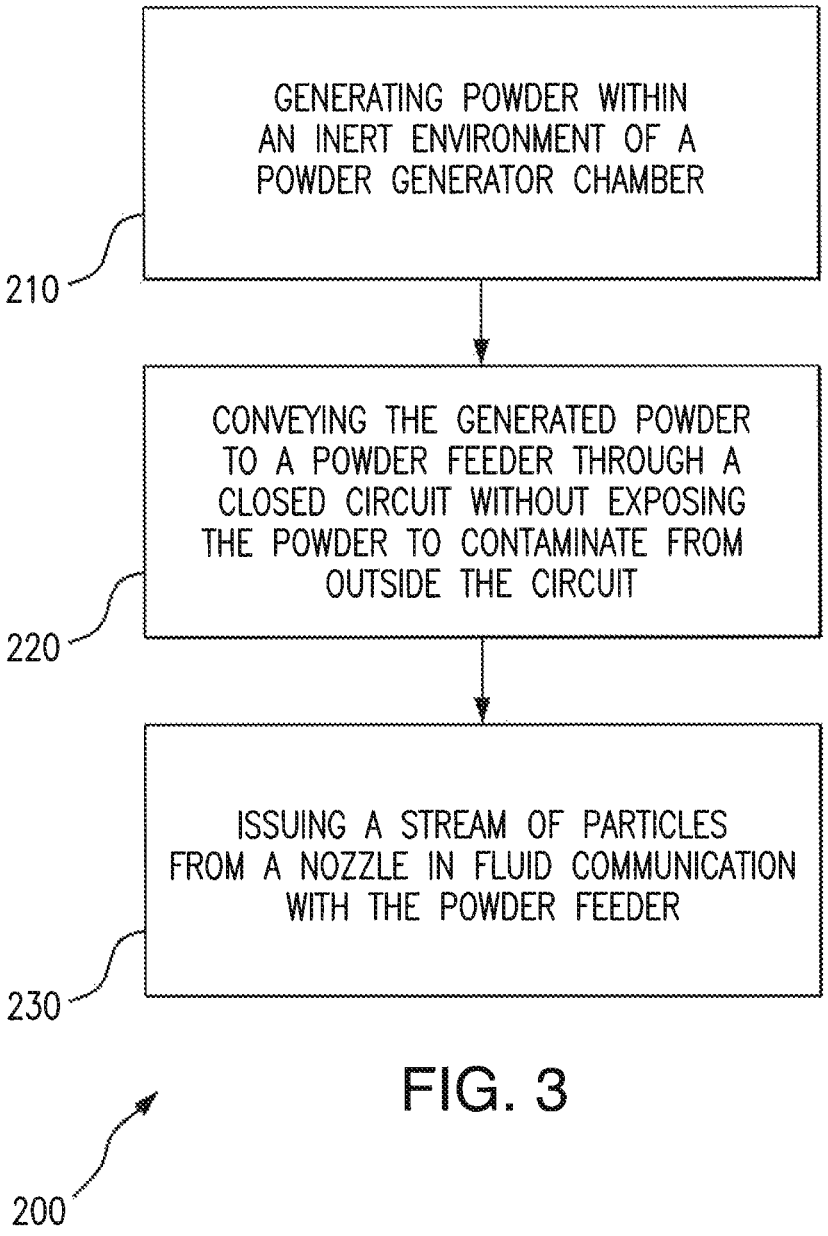
FIG. 3 is a process flow diagram of an exemplary embodiment of a cold spray method, showing method operations.

With reference to FIG. 3, a cold spray method 200 is shown. Cold spray method 200 includes (a) generating a powder within an inert environment of a powder generator chamber at a step 210, (b) conveying the generated powder to a powder feeder through a closed circuit without exposing the powder to contaminate from outside the closed circuit at a step 220, and (c) issuing a flow of particles from a nozzle in fluid communication with the powder feeder at a step 230.

Figure 4:
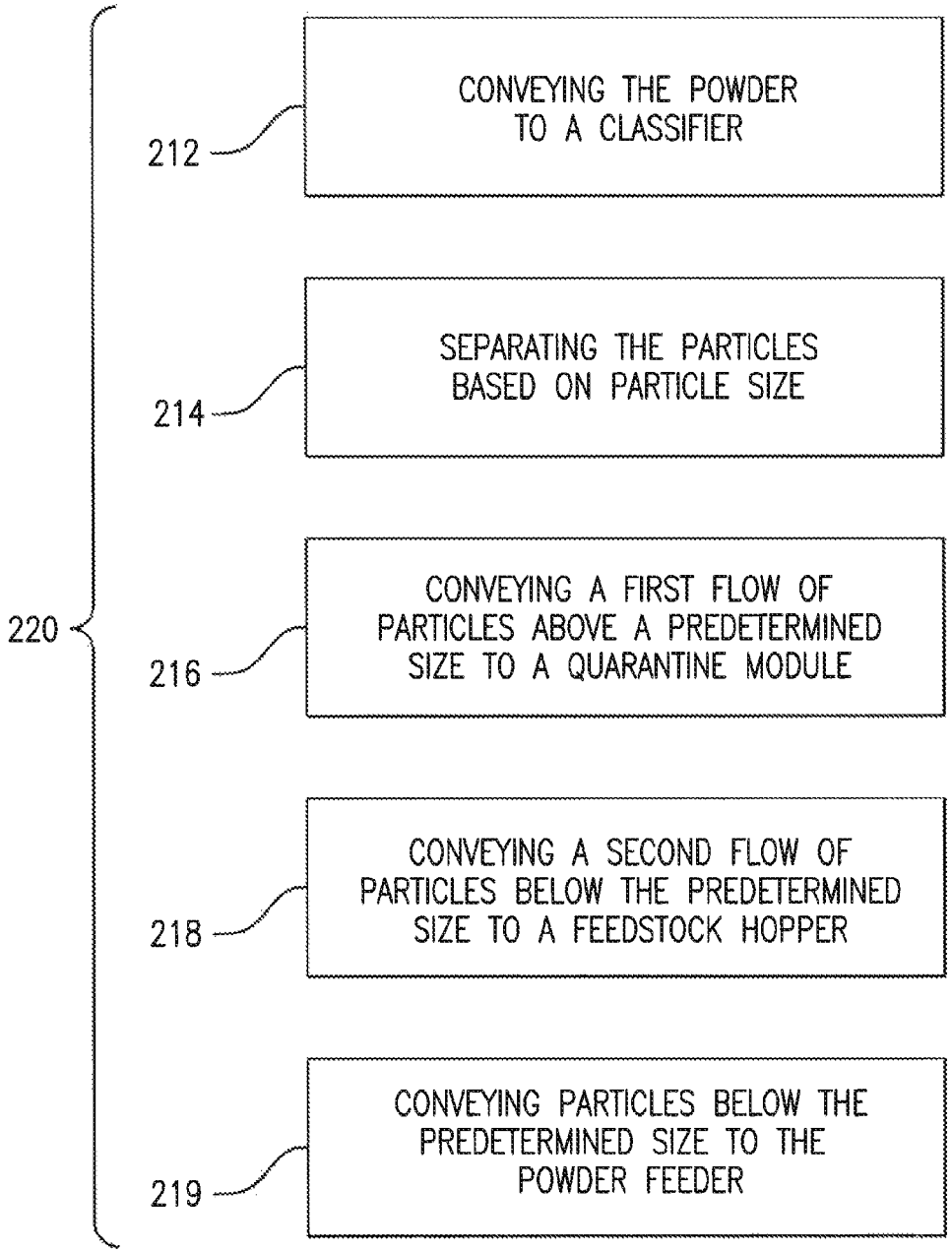
FIG. 4 is a process flow diagram of second cold spray method, showing conveying operations of the method.

With reference to FIG. 4, conveying step 220 can additionally include (1) conveying powder to a classifier at a step 212, (b) separating the particles based on particle size at step a 214, (c) conveying a first flow of particles above a predetermined size to a quarantine module at a step 216, (d) conveying a second flow of particles below the predetermined size to a feeder hopper at a step 218, and (e) conveying particles below the predetermined size (e.g. the second flow) to the powder feeder at a step 219. Optionally, the first flow can be introduced to the powder feeder via an inert coupling for subsequent application to a substrate.

In certain embodiments, the systems and methods described herein potentially provide very thick deposits of high quality and/or strength materials. Systems and methods described herein can also provide a process akin to conventional additive manufacturing processes. In certain embodiments, the systems and methods described herein allows for storing powder feedstock (subsequent to manufacture) in an inert atmosphere prior to deposition. This removes the constraint of simultaneous powder generation and deposition characteristic of conventional cold spray systems. It also potentially allows for shifting in time deposition of powder and production and classification of powder—without exposure of the powder to the atmosphere and/or contaminates during the intervening period.

The methods and systems of the present disclosure, as described above and shown in the drawings, can provide for coatings with superior properties including uniformity, and particularly, absence of oxides, hydroxides, and the like. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A cold spray system, comprising:

a powder generator having a powder source disposed within a housing;

a powder feeder in fluid communication with the housing, wherein a closed circuit with an inert atmosphere is defined from the powder generator to the powder feeder for conveying powder from the powder generator to the powder feeder without exposing the powder to contaminates from outside the closed circuit; and a motive gas system in fluid communication with the powder generator for propelling particles produced in the powder generator through the closed circuit.

2. A system as recited in claim 1, wherein in the powder generator is housed within a generator chamber with an inert atmosphere.

3. A system as recited in claim 1, wherein the powder generator, powder feeder, and closed circuit are configured to supply particles having surface and interior portions with substantially the same composition.

4. A system as recited in claim 1, further comprising voltage source and return terminals operatively associated with the powder generator for developing an arc within the generator.

5. A system as recited in claim 4, further comprising first and second feedstock wires, bars, or rods connected to the voltage source and return terminals for generating an arc between the wires.

6. A system as recited in claim 5, wherein the first and second feedstock wires include aluminum or aluminum alloy.

7. A system as recited in claim 6, further comprising respective first and second wire feeders configured to feed the first and second wires within the chamber as the first and second wires are consumed to produce particles.

8. A system as recited in claim 1, wherein the motive gas system includes a supply of inert gas selected from the group consisting of argon, helium, and nitrogen.

9. A cold spray system, comprising:

a powder generator having a powder source disposed within a housing;

a powder feeder in fluid communication with the housing, wherein a closed circuit with an inert atmosphere is defined from the powder generator to the powder feeder for conveying powder from the powder generator to the powder feeder without exposing the powder to contaminates from outside the closed circuit and a classifier in fluid communication with the powder generator, wherein the classifier is configured for removing particles outside of a predetermined size range from a particle flow through the closed circuit.

10. A system as recited in claim 9, wherein the classifier includes a vortex generator for separating particles by particle size.

11. A system as recited in claim 10, further including a quarantine module with an inert atmosphere in selective fluid communication with the classifier for capturing particles above a predetermined size separated by the classifier.

12. A system as recited in claim 11, wherein the quarantine module has an inert atmosphere for storing particles above a predetermined size separated by the classifier.

13. A cold spray system, comprising:

a powder generator having a powder source disposed within a housing;

a powder feeder in fluid communication with the housing, wherein a closed circuit with an inert atmosphere is defined from the powder generator to the powder feeder for conveying powder from the powder generator to the powder feeder without exposing the powder to contaminates from outside the closed circuit; and a feedstock hopper in fluid communication with the powder generator and with the powder feeder for storing particles to regulate between a particle production rate of the powder generator and a particle usage rate of the powder feeder.

14. A system as recited in claim 1, further including an issue nozzle in fluid communication with the powder generator and configured for issuing a spray of powder at a substrate arranged opposite the nozzle.

15. A cold spray system, comprising:

a powder generator having a powder source disposed within a housing;

a classifier for removing particles outside of a predetermined size range from a particle flow received from powder generator;

a feedstock hopper for storing particles received from the classifier to regulate between a particle production rate of the powder generator and a particle usage rate of the powder feeder; and a powder feeder for feeding a consistent flow of particles received from the feedstock hopper, wherein a closed circuit with an inert atmosphere is defined from the powder generator to the powder feeder including the classifier and feedstock hopper for conveying powder from the powder generator to the powder feeder without exposing the powder to contaminates from outside the closed circuit.

16. A system as recited in claim 15, further including a quarantine module with an inert atmosphere in selective fluid communication with the classifier for capturing particles above a predetermined size separated by and received from the classifier.

17. A system as recited in claim 16, wherein the quarantine module has an inert atmosphere for storing particles above a predetermined size separated by the classifier.

18. A system as recited in claim 16, wherein the classifier has a first outlet in fluid communication with the feedstock hopper for discharging a flow of particles within the predetermined range, wherein the classifier has a second outlet in fluid communication with the quarantine module for discharging a flow of particles outside of the predetermined range.

19. A method of cold spraying, comprising:

generating powder within an inert environment of a powder generator chamber;

removing particles of a predetermined size from the generated powder;

conveying the generated powder having particles smaller than the predetermined size to a powder feeder in fluid communication with the power generator through a closed circuit without exposing the powder to contaminate from outside the closed circuit; and issuing a flow of particles as a spray from a nozzle in fluid communication with the powder feeder.

* * * * *